US006276622B1

(12) United States Patent
Obitz

(10) Patent No.: US 6,276,622 B1
(45) Date of Patent: Aug. 21, 2001

(54) REFINING DISC FOR DISC REFINERS

(75) Inventor: Lars Obitz, Vaxholm (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/508,595

(22) PCT Filed: Sep. 17, 1998

(86) PCT No.: PCT/SE98/01670

§ 371 Date: Mar. 13, 2000

§ 102(e) Date: Mar. 13, 2000

(87) PCT Pub. No.: WO99/13989

PCT Pub. Date: Mar. 25, 1999

(30) Foreign Application Priority Data

Sep. 18, 1997 (SE) ..... 9703373

(51) Int. Cl.[7] ..... B02C 7/12
(52) U.S. Cl. ..... 241/261.3; 241/298

(58) Field of Search ..... 241/28, 261.2, 241/261.3, 296, 297, 298

(56) References Cited

U.S. PATENT DOCUMENTS 3,674,217 7/1972 Reinhall .
4,023,737 5/1977 Leider et al. .
5,975,438 * 11/1999 Garasimowicz ..... 241/28

* cited by examiner

*Primary Examiner*—Mark Rosenbaum
(74) *Attorney, Agent, or Firm*—Lerner, David, Littenberg, Krumholz & Mentlik, LLP

(57) ABSTRACT

Refining disks are disclosed including a plurality of ribs generally extending outwardly towards the outer end of the disk across its surface, the plurality of ribs having a uniform width and being curved with the shape of an involute arc with circular evolutes. Disk refiners including such refining disks are also disclosed.

3 Claims, 1 Drawing Sheet

REFINING DISC FOR DISC REFINERS

FIELD OF THE INVENTION

The present invention relates to a refining disk for disk refiners of the type that includes spaced ridges or ribs which extend over the refining zones of the disk.

BACKGROUND OF THE INVENTION

In disk refiners fitted with refining disks of the above-described type, the material to be refined is treated in a space defined between two refining disks, and the fibers in that material are treated at the location where the ribs or ridges meet one another. Because the ribs meet at an angle to one another as the disks rotate, so-called clip refining occurs. This should be avoided, since it impairs the quality of the treated material.

Attempts have been made to solve this problem by using spaced arcuate ribs or ridges; reference in this regard can be made to U.S. Pat. Nos. 3,674,217 and 4,023,737. It is stated in these prior patents that the fiber material will be worked uniformly when the ribs or ridges are arcuate and that defibration is achieved with the minimum of fiber clipping. These proposals, however, do not provide any real solution to the problem, since the ridges on the two counteracting disks do not meet each other along their full lengths, in spite of this.

The object of the present invention is thus to solve the aforesaid problems and to avoid clip-refining of the material being treated.

SUMMARY OF THE INVENTION

In accordance with the present invention, these and other objects have now been realized by the invention of a refining disk having a surface, an inner end and an outer end and including a plurality of ribs generally extending outwardly towards the outer end across the surface, the plurality of ribs having a uniform width and being curved with the shape of an involute arc with circular evolutes.

In accordance with one embodiment of the present invention, a disk refiner is disclosed including a first refining disk and a second relatively rotatable refining disk facing the first refining disk with a refining space therebetween, the first and second refining disks having a surface, an inner end and an outer end and including a plurality of ribs generally extending outwardly towards the outer end across the surface, the plurality of ribs including a pair of edges and having a uniform width, and being curved with the shape of an involute arc with circular evolutes, whereby the direction of rotation of the first refining disk can be reversed so that both of the pair of edges of the ribs can be used for refining purposes. In a preferred embodiment, the plurality of ribs on the first refining disk have a first pitch and the plurality of ribs on the second refining disk have a second pitch, the first pitch and the second pitch being different.

BRIEF DESCRIPTION OF THE DRAWINGS

The present invention will now be described in more detail with reference to the following detailed description which, in turn, refers to the accompanying drawings, in which.

DETAILED DESCRIPTION

Figure 1:
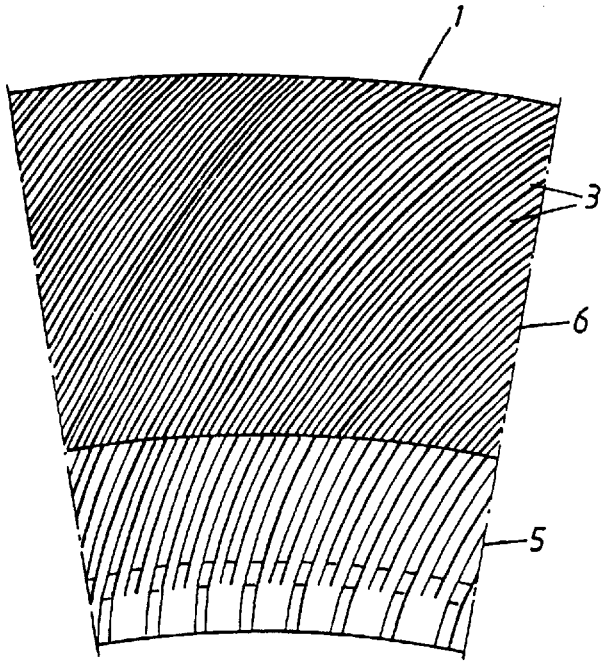
FIG. 1 is a top, elevational view of a refining disk segment as seen from the material refining gap.

Referring first to FIG. 1, there is shown therein a refining segment 1 which is disposed on the inside of a refining disk and which is intended for coaction with the refining segment 2 on an adjacent refining disk on the other side of the refining gap. The ribs or ridges, 3 and 4, on the respective segments, 1 and 2, are curved and follow involute arcs having a circular evolute.

This ridge shape has been found to have several advantageous effects. When the two disks rotate in opposite directions and constitute a mirror image of one another, the ridges 3 and 4 will meet each other along their full lengths simultaneously, regardless of their mutual angular positions. This completely eliminates so-called clip-refining, which otherwise occurs when the ribs or ridges meet at a certain angle to one another. This ridge configuration also results in ridges and grooves of constant widths in respective refining zones perpendicular to the tangent of the involute, regardless of the radius. In the illustrated case, the refining segments are divided into two refining zones, to wit a radially inner infeed zone 5 and a radially outer refining zone 6.

This ridge, or rib, configuration comprising involute arcs with a circular evolute also enables the refiner to function as a double-rotating refiner; i.e., it enables the direction of rotation of the refining disks to be reversed, therewith allowing both edges of the ridges, 3 and 4, to be used for refining purposes.

Another advantage of same is that one rotor feeds in the material while the other rotor acts as a counterpressure or anvil surface. This results in a shear force that acts radially on the material being worked and not solely in a tangential direction, as is the case with conventional refining segments.

Figure 2:
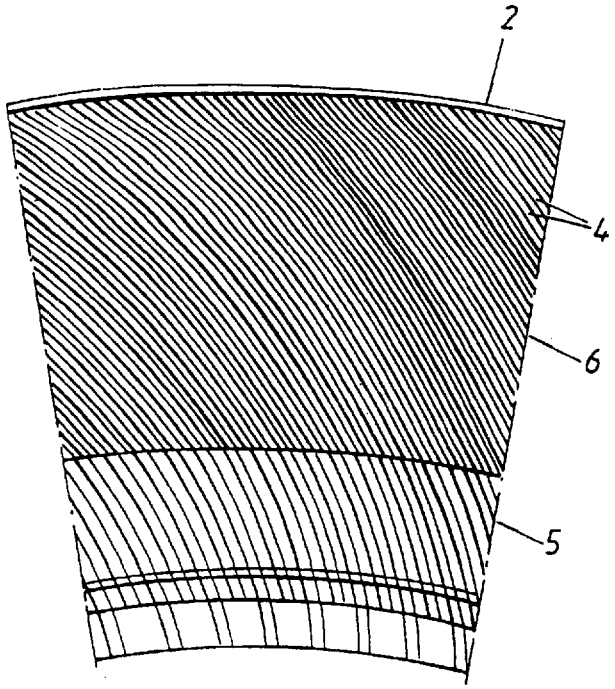
FIG. 2 is a top, elevational view of an adjacent refining disk segment as seen from the other side of said gap.

FIGS. 1 and 2 also show separate finesse, whereby the pitch is slightly different in the two segments 1 and 2, such that not all ribs or ridges will meet each other simultaneously over the whole surface during refining of the material, thereby to more uniform loading of the system.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A refining disk having a surface, an inner end and an outer end and including a plurality of ribs generally extending outwardly towards said outer end across said surface, said plurality of ribs having a uniform width and being curved with the shape of an involute arc with circular evolutes.

2. A disk refiner including a first refining disk and a second relatively rotatable refining disk facing said first refining disk with a refining space therebetween, said first and second refining disks having a surface, an inner end and an outer end and including a plurality of ribs generally extending outwardly towards said outer end across said surface, said plurality of ribs including a pair of edges and having a uniform width, and being curved with the shape of an involute arc with circular evolutes, whereby the direction of rotation of said first refining disk can be reversed so that both of said pair of edges of said ribs can be used for refining purposes.

3. The disk refiner of claim 2 wherein said plurality of ribs on said first refining disk have a first pitch and said plurality of ribs on said second refining disk have a second pitch, said first pitch and said second pitch being different.

* * * * *